US006529066B1

(12) United States Patent
Guenot et al.

(10) Patent No.: US 6,529,066 B1
(45) Date of Patent: Mar. 4, 2003

(54) LOW VOLTAGE BAND GAP CIRCUIT AND METHOD

(75) Inventors: Stephane Guenot, Grass Valley, CA (US); Jeffrey P. Kotowski, Nevada City, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/793,665

(22) Filed: Feb. 26, 2001

Related U.S. Application Data

(60) Provisional application No. 60/185,315, filed on Feb. 28, 2000.

(51) Int. Cl.[7] ..... G05F 1/10

(52) U.S. Cl. ..... 327/539; 327/540; 327/543; 327/512; 323/313; 323/316

(58) Field of Search ..... 327/539, 540, 327/541, 542, 543, 512, 513; 323/312, 313, 314, 315, 316

(56) References Cited

U.S. PATENT DOCUMENTS 5,352,973 A * 10/1994 Audy ..... 323/313
5,581,174 A * 12/1996 Fronen ..... 323/316
5,796,244 A * 8/1998 Chen et al. ..... 323/313
5,867,012 A * 2/1999 Tuthill ..... 323/313

OTHER PUBLICATIONS

Banba et al.., "A CMOS Bandgap Reference Circuit with Sub–1–V Operation," IEEE Journal of Solid–State Circuits vol. 34, No. 5 May 1999: 670–674.

* cited by examiner

*Primary Examiner*—Tuan T. Lam
*Assistant Examiner*—An T. Luu
(74) *Attorney, Agent, or Firm*—Girard & Equitz LLP

(57) ABSTRACT

A band gap circuit that may be implemented in a standard CMOS process including a pair of parasitic vertical PNP transistors operating at a different current density. The PNP transistors have common collectors and common bases and produce a difference in base-emitter voltages which is developed across a resistor so as to produce a current having a positive temperature coefficient. The current is used to produce a positive temperature coefficient voltage which is combined with another voltage having a negative temperature coefficient to produce a band gap reference voltage. A bias voltage is applied between the base and collector of each of the PNP transistors, typically on the order of 500 millivolts. This causes the emitters of the PNP transistors to be at a voltage which can be sensed by an error amplifier implemented with standard N type MOS input transistors while maintaining a capability of operating using a relatively low power supply voltage.

24 Claims, 3 Drawing Sheets

LOW VOLTAGE BAND GAP CIRCUIT AND METHOD

CROSS REFERENCE TO RELATED APPLICATIONS

The present application claims the benefit of the provisional application filed on Feb. 28, 2000 having application Ser. No. 60/185,315 and entitled Low-Voltage Band Gap with Boosted Base PNP pursuant to 35 U.S.C.§119(e).

BACKGROUND OF THE INVENTION

1. Field of the Invention

The present invention relates generally to analog circuitry and, in particular, to band gap circuitry used to generate reference voltages having a controllable temperature coefficient.

2. Description of Related Art

In analog and mixed signal circuits, a reference voltage is sometimes needed that does not vary over temperature or that varies in a predetermined way over temperature. Typical of such circuits is a circuit commonly referred to as a band gap voltage reference circuit. A band gap circuit relies upon a difference in base-emitter voltage of two bipolar transistors, with such difference voltage having a positive temperature coefficient. That difference voltage, or a voltage derived from the difference voltage, is combined with another voltage, typically a base-emitter voltage, having a negative temperature coefficient, to produce a reference voltage. In most cases, the voltages are combined so that the reference voltage has a zero temperature coefficient, but the reference voltage can also have a controlled positive or controlled negative temperature coefficient if desired. Regardless of the temperature coefficient of the reference voltage, such circuits are referred to herein as band gap circuits or band gap reference circuits.

In a CMOS process, the only bipolar transistors available are parasitic vertical PNP transistors having their respective collectors formed in a common P type substrate. This places limits of the implementation of circuits using those transistors. Various CMOS band gap voltage reference circuits have been developed, many of which have limitations on the minimum supply voltage.

Referring to the drawings, FIG. 1 is a diagram of one such prior art band gap reference circuit. A pair of parasitic vertical PNP transistors 8A and 8B are included which are diode-connected with the base and collectors of each transistor being connected to the circuit common. Transistor 8B is implemented having an emitter area which is twenty-four times (24×) as large as the emitter area of transistor 8A (1×). The emitters of transistors 8A and 8B are respectively connected to the drains of a pair of similar P type MOS transistors 6A and 6B. Transistor 8B is connected to MOS transistor 6B by way of a resistor R1.

A third P type MOS transistor 6C, having a gate connected in common with the gates of transistors 6A and 6B, is connected to an emitter of a third parasitic vertical PNP transistor 10 by way of a resistor R2. All three MOS transistors 6A, 6B and 6C have their sources connected in common to the supply voltage. PNP transistor 10 has the same emitter area (1×) as transistor 8B and is also connected as a diode, with base and collector connected to the circuit common. An operational amplifier 12, which functions as an error amplifier, has an output connected to the common gates of transistors 6A, 6B and 6C, an inverting input connected to a node A intermediate transistors 6A and 8A and a non-inverting input connected to a node B intermediate resistor R1 and transistor 6B.

In operation, amplifier 12 controls the gate-source voltage of transistors 6A, 6B and 6C such that the voltages at nodes A and B are equal, ignoring the small input offset voltage of the amplifier. Transistors 6A and 6B are the same size and have the same gate-source voltage so that both transistors will conduct approximately the same current Ith. Transistors 8A and 8B will also conduct the same current, Ith, with transistor 8A operating at twenty-four times the current density given that the emitter area of the transistor only 1× compared to the 24× of transistor 8B. As is well known, transistors 8A and 8B will operate at different base-emitter voltages (ΔVbe) with such difference voltage being relatively independent of the absolute magnitude of the current. The equation for ΔVbe is as follows, with Ja and Jb representing the current density of transistors 8A and 8B, respectively:

$$\Delta Vbe = Vt \ln \frac{Ja}{Jb} \tag{1}$$

Vt is the thermal voltage (kT/q). Assuming that transistors 8A and 8B conduct the same current Ith, the ratio of current density is determined solely by the 1/24 ratio of emitter areas, resulting in ΔVbe of 80 millivolts. Thus, assuming that the Vbe of transistor 8A is, for example, 650 millivolts, the Vbe of transistor 8B will be 80 millivolts less or 570 millivolts at room temperature. Since the voltages at nodes A and B are equal, the ΔVbe voltage of 80 millivolts will be dropped across resistor R1. In a typical application, resistor R1 will be set to about 160 kohms thereby setting current Ith to 500 nanoamperes (80 millivolts/160 kohms). As can be seen in equation (1), voltage ΔVbe has a positive temperature coefficient since Vt has a positive temperature coefficient of +0.085 millivolts/° C. Thus, current Ith will also have a positive temperature coefficient.

The band gap output voltage Vbg is the sum of the base-emitter voltage of transistor 10, voltage Vbe(10), and the voltage drop across resistor R2, voltage V(R2). Since the base-emitter voltage Vbe(10), typically 650 (millivolts), has a negative temperature coefficient (−2 millivolts/° C.), the value of resistor R2 is selected so that a positive temperature coefficient voltage V(R2) is produced having a magnitude sufficient to offset the negative temperature coefficient of voltage Vbe(10). Setting resistor R2 to 1.2 Meg ohms will produce a voltage V(R2) of about 600 millivolts. This will produce a band gap output voltage Vbg of 1.25 volts having the desired first order zero temperature coefficient.

One of the limitations of the FIG. 1 prior art circuit relates to the implementation of the operational amplifier 12. FIG. 2A is a simplified diagram of the input stage of an amplifier utilizing N type MOS devices and FIG. 2B is a diagram of an input stage utilizing P type devices. Referring first to FIG. 2A, input V+, the gate of transistor 16A, is connected to node A of FIG. 1 and input V−, the gate of transistor 16B, is connected to node B. As previously noted, both nodes A and B are at 650 millivolts, the base-emitter voltage of transistor 8A.

In order for the FIG. 2A amplifier to operate properly, inspection of the input indicates that the voltage at the inputs, the common mode input voltage, must be at least as large as the sum of the gate-source voltage Vgsn of N type transistor 16A and voltage Vdsatn of tail current source N type transistor. Voltage Vdsatn is the minimum drain-source voltage necessary for transistor 18 to operate in the saturation region where the transistor functions as a current source. The gate-source voltage Vgsn is equal to Vdsatn+Vtn where Vtn is the threshold voltage of the N type transistors. Assuming that Vtn is 700 millivolts and Vdsatn is 200 millivolts, it can be seen that the FIG. 2A amplifier requires a minimum common mode input voltage of 1.1 volts, well above the actual voltage of 650 millivolts at the amplifier inputs. This presents a problem.

One solution to the above noted problem is to use MOSfet having a reduced threshold voltage, usually in the range of 200 millivolts. However, such devices are typically not available on standard CMOS processes. Another approach is to use an input stage having P type devices as shown in FIG. 2B. Inspection of the FIG. 2B circuit shows that the supply voltage must be at least equal to the sum of the voltage applied to the gates of input transistors 22A and 22B, the voltage at nodes A and B, plus the sum of the gate-source voltage Vgsp of P type transistor 22A/22B and voltage Vdsatp of tail current source transistor 20. Voltage Vdsatp is the minimum drain-source voltage of transistor 20 which will permit the transistor to operate as a current source. Again, the value of Vgsp is the sum of the threshold voltage of Vtp of the P type device and voltage Vdsatp of the transistor. Assuming that the threshold voltage of a P type device using a standard CMOS process is 900 millivolts and that voltage Vdsatp is 200 millivolts, the voltage at the inputs of the amplifier must be at least 1.3 volts below the supply voltage for the input stage to operate. Since the inputs to the amplifier (nodes A and B) must be at least 650 millivolts, the minimum power supply voltage is 1.95 volts. This minimum supply voltage value is too high for some applications.

There is a need for a band gap voltage reference circuit which can utilize a standard CMOS process and which can satisfactorily operate with a supply voltages significantly less than 2 volts. The present invention provides a band gap reference circuit that can be implemented using a standard CMOS process and which can operate at supply voltages substantially less that 2 volts. These and other advantages of the present invention will become apparent to those skilled in art from a reading of the following Detail Description of the Invention together with the drawings.

SUMMARY OF THE INVENTION

A band gap circuit is disclosed which is capable of being implemented using a standard CMOS process. The circuit includes first and second bipolar transistors, such as vertical PNP transistors, having respective bases connected together and respective collectors connected together. Current biasing circuitry is provided which is coupled to the emitters of the first and second bipolar transistors that causes the two transistors to operate at different current densities. Typically, the two transistors have differing emitter areas, with the current biasing circuitry operating to cause current flow through the two transistors to be equal so that a difference in current density is maintained.

The band gap circuit further includes voltage biasing circuitry coupled intermediate the bases and the collectors of the bipolar transistors which is configured to produce a non-zero base-collector bias voltage. Preferably, the bias voltage is on the order of 500 millivolts. The bias voltage operates to elevate the emitter voltage of the two transistors to allow the use of a differential amplifier having standard N type MOS input transistors to be used as part of the current biasing circuitry.

DETAILED DESCRIPTION OF THE INVENTION

Figure 1:
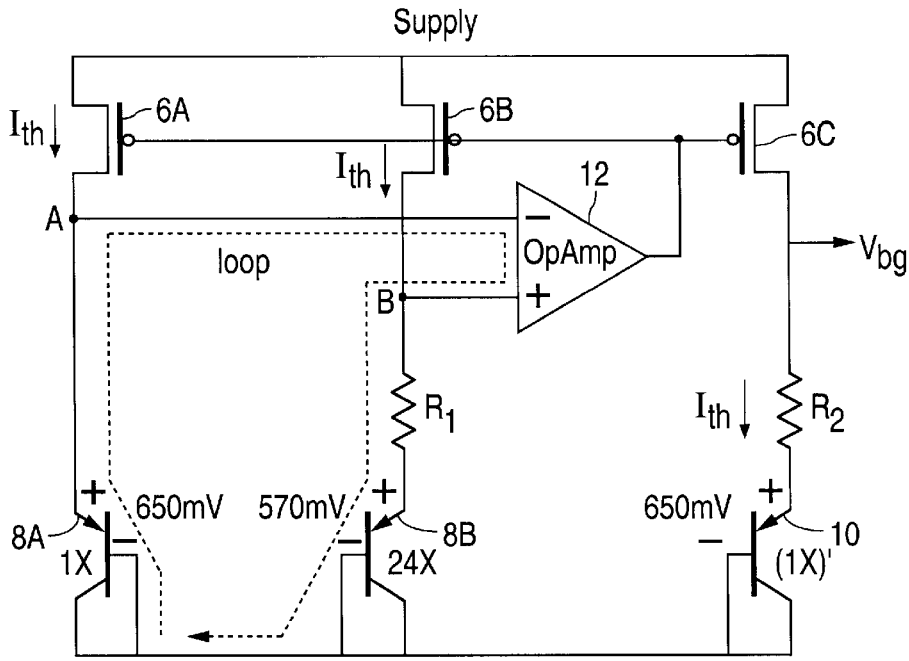
FIG. 1 (PRIOR ART)
FIG. 1 is a schematic diagram of a convention band gap reference circuit implemented using a CMOS process.
Figure 3:
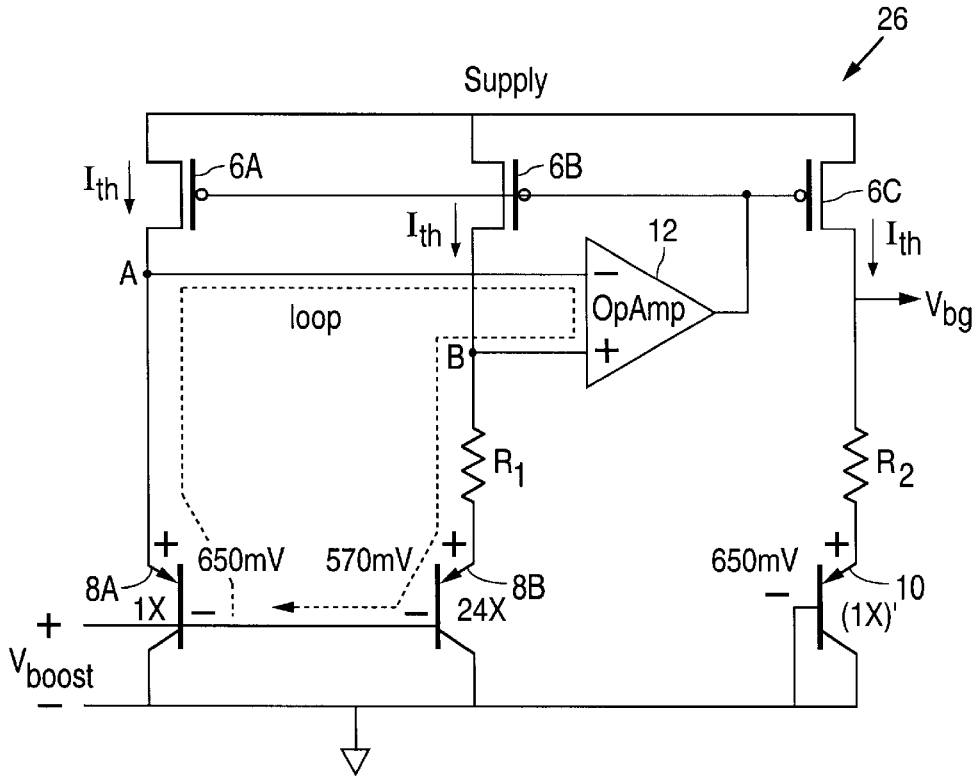
FIG. 3 is a schematic diagram of a band gap reference circuit in accordance with the present invention.

Referring again to the drawings, FIG. 3 is a schematic diagram of one implementation of a band gap reference circuit in accordance with the present invention. The basic topology is generally the same as the prior art circuit of FIG. 1, with similar circuit components being given the same designation. With respect to the parasitic vertical PNP transistors 8A and 8B, rather than being diode-connected as in FIG. 1, the common base electrodes are connected in common to a bias voltage, sometimes referred to as a boost voltage, Vboost. In the present example, voltage Vboost is set to 500 millivolts.

Note that the presence of the boost voltage does not affect the value of Ith which, as previously noted, is equal to ΔVbe/R1. Thus, the band gap voltage Vbg also remains unchanged. However, the voltage at nodes A and B will be increased by 500 millivolts from 650 millivolts (Vbe) to 1.15 volts. This increased voltage at nodes A and B is sufficiently large to permit the use of an operational (error) amplifier 12 using N type devices which, as previously noted, require at least 1.1 volts at the inputs. Importantly, the N type amplifier can be used without the need for low threshold devices thereby permitting the use of standard CMOS processes.

Figure 2A:
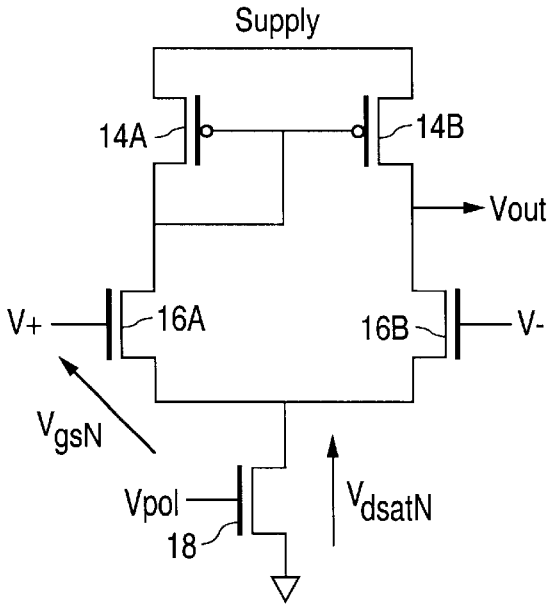
FIG. 2A (PRIOR ART)
FIG. 2A is a schematic diagram of an N type MOS input stage of conventional operational amplifier as used in the reference circuit of FIG. 1.
Figure 2B:
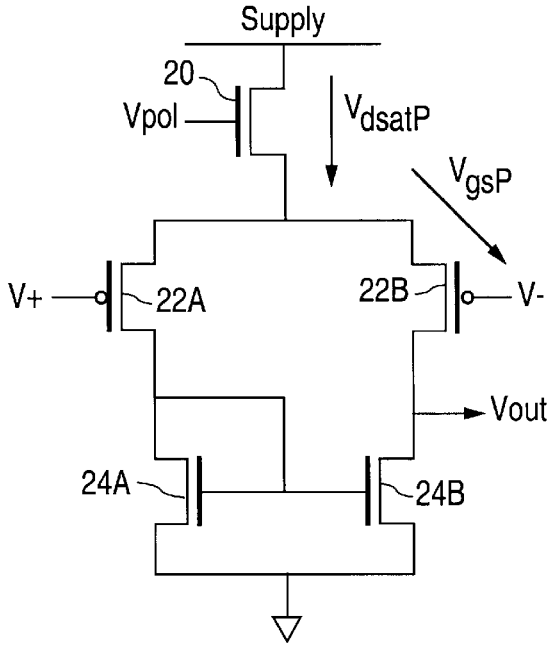
FIG. 2B (PRIOR ART)
FIG. 2B is a schematic diagram of a P type MOS input stage of conventional operational amplifier as used in the reference circuit of FIG. 1.

The minimum supply voltage for the FIG. 2A amplifier is the sum of voltage Vdsatn of transistor 18 (200 millivolts), voltage Vdsatn of transistor 16A (200 millivolts) and voltage Vgsp of transistor 14A (1.1 volts) or 1.5 volts. This is an improvement over the minimum supply voltage of 1.95 volts required if the P type input of FIG. 2B were used.

Figure 4:
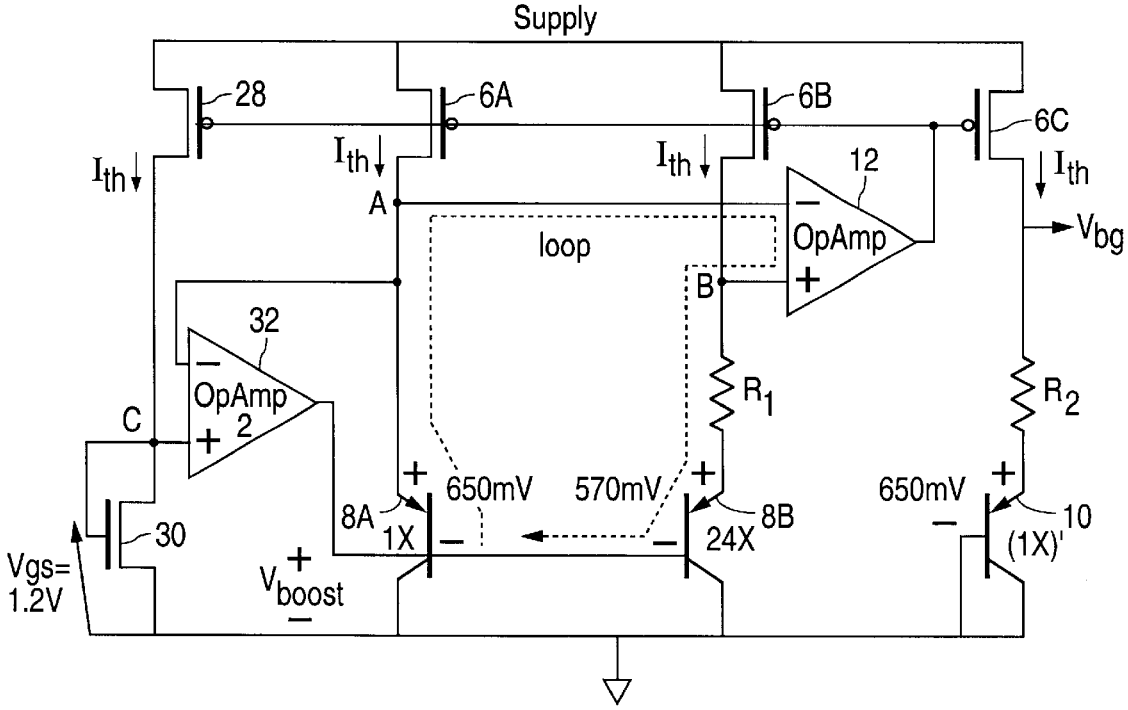
FIG. 4 is a schematic diagram of one embodiment of a band gap reference circuit in accordance with the present invention.

The boost voltage Vboost applied to transistors 8A and 8B can be generated in a variety of ways. The objective is to provide a base-collector bias voltage that is equal to the minimum common mode input voltage of error amplifier 12, less the base-emitter voltage of PNP transistor 8A. The bias voltage can be greater, but at the cost of increasing the minimum supply voltage. FIG. 4 shows one manner of implemented the boost voltage feature. An additional P type MOS transistor 28 is added which is connected relative to transistors 6A, 6B and 6C so as to also conduct current Ith. This current is conducted through an N type MOS transistor 30 connected as a diode. A gate-source voltage of 1.2 volts is produced at the common gate and drain of transistor 30, node C.

A second operational amplifier 32 is included, having a non-inverting input connected to node C and an inverting input connected to node A. The output of amplifier 32, which produces voltage Vboost, is connected to the common bases of PNP transistors 8A and 8B. Amplifier 32, by virtue of feedback, will adjust voltage Vboost so as to force the voltage at node A to be equal to the voltage at node C, 1.2 volts. This is accomplished by adjusting voltage Vboost to about 550 millivolts (1.2V–0.650V). Transistor 30 is preferably implemented having a W/L ratio related to that of amplifier input transistors 16A/16B (FIG. 2A) so that the gate-source voltage of transistor 30 is equal to the sum of the gate-source voltage of transistors 16A/16B and voltage Vsdatn of transistor 18. This will cause the gate-source voltage produced by transistor 30 to track the common mode input voltage of the amplifier over temperature and process. This permits voltage Vboost to be the minimum boost voltage needed and to track the amplifier common mode input voltage over temperature and process.

Figure 5:
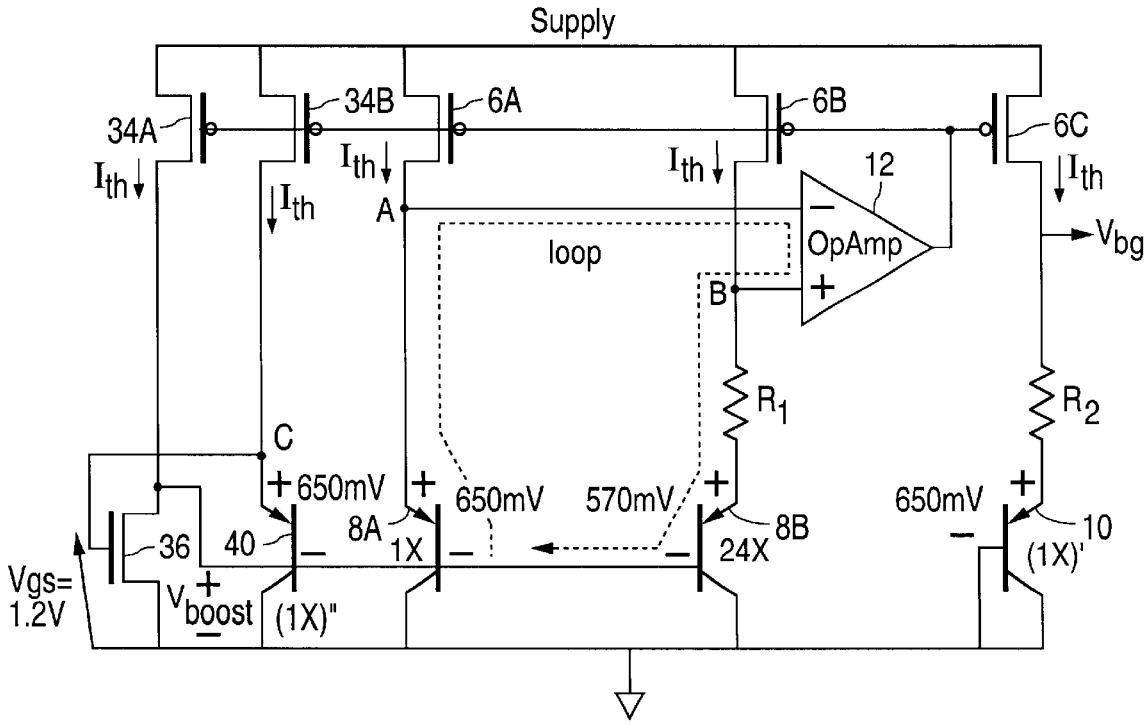
FIG. 5 is a schematic diagram of another embodiment of a band gap reference circuit in accordance with the present invention.

FIG. 5 is a schematic diagram of another implementation of circuitry for producing the boost voltage Vboost. Two additional P type MOS transistors 34A and 34B are connected with respect to transistors 6A, 6B and 6C so as to also conduct current Ith. A third vertical PNP transistor 40 is included having an emitter area equal to that of transistor 8A (1×). Transistor 40 is connected with the emitter coupled to transistor 34B and the collector coupled to the circuit common. The base of transistor 40 is connected to the common bases of PNP transistors 8A and 8B.

An N type MOS transistor 36 is included having a gate connected to the emitter of transistor 40, which forms node C. The source of transistor 36 is connected to the circuit common and the drain is connected to transistor 34A so that transistor 36 will conduct also current Ith. The gate-source voltage of transistor 36, 1.2 volts, is thus applied to node C, maintaining the emitter of transistor 40 at that voltage. The base of transistor 40, where voltage Vboost is produced, is one base-emitter voltage less that the node C voltage or 550 millivolts (1.2 V–0.650 V). Again, as was the case with transistor 30 of FIG. 4, transistor 36 is preferably implemented to operate at a gate-source voltage which is equal the sum of the gate-source voltage of amplifier input transistors 16A/16B and voltage Vdsatn of transistor 18 to provide tracking over process and temperature.

The FIG. 5 implementation is generally preferred over that of FIG. 4. Since transistors 8A and 40 are both PNP transistors having the same emitter area and conducting the same current Ith, the base-emitter voltages will be closely matched and will track over process and temperature. This feature assist in further reducing the size of the minimum supply voltage.

Figure 6:
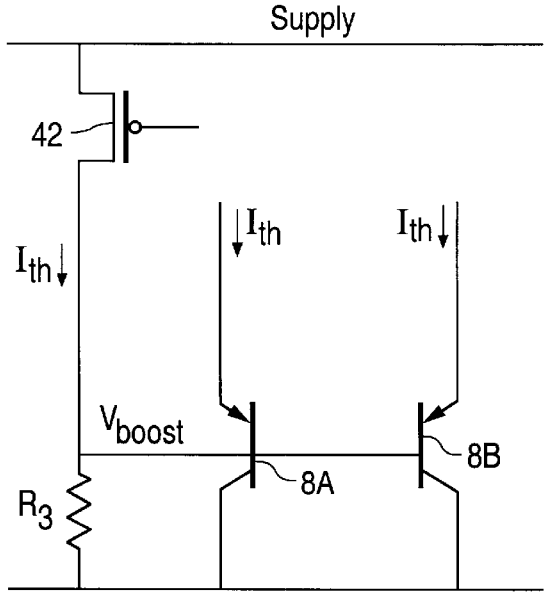
FIG. 6 is a schematic diagram of a still further embodiment of a band gap reference circuit in accordance with the present invention.

FIG. 6 shows a still further implementation of circuitry for producing voltage Vboost. A resistor R3 is provided which conducts current Ith provided by a P type MOS transistor 42 connected with respect to transistors 6A, 6B and 6C (not depicted). Resistor R3 is sized with respect to current Ith so as to provide a boost voltage Vboost of 550 millivolts. This implementation is not preferred over those previously discussed because matching would be poor over temperature and process.

Thus, various embodiments of a band gap reference circuit have been disclosed that can be implemented using a standard CMOS process and which allows operation at reduced power supply levels. By way of example, different values of the boost voltage could be produced other than values near 550 millivolts, depending upon the particular application. Preferably, the boost voltage is on the order of 500 millivolts. While these embodiments have been described in some detail, it is to be understood that various changed can be made by those skilled in the art without departing from the spirit and scope of the invention as defined by the appended claims.

What is claimed is:

1. A band gap circuit comprising:

first and second vertical PNP transistors having respective collectors connected in common and respective bases connected in common;

a resistor having first and second terminals, with the first terminal connected to an emitter of the first PNP transistor;

current biasing circuitry coupled to the first and second bipolar PNP transistors so that the PNP transistors operate at different current densities, said current biasing circuitry including an error amplifier implemented using P and N type MOS transistors, including a pair of differentially-connected N type MOS transistors and having a first input connected to an emitter of the second PNP transistor and a second input connected to the second terminal of the resistor and an output connected to maintain a same voltage at the first and second error amplifier inputs, with the error amplifier having a minimum common mode input voltage; and voltage bias circuitry coupled to the first and second PNP transistors and configured to produce a base-collector bias voltage in the first and second PNP transistors, with the base-collector bias voltage being approximately equal to the minimum common mode input voltage less a base-emitter voltage of the second PNP transistor, with the voltage bias circuitry including a third PNP transistor connected to conduct a current equal to a current through each of the first and second PNP transistors.

2. The band gap circuit of claim 1 wherein the first bipolar transistor has an emitter area greater than an emitter area of the second bipolar transistor and wherein the current biasing circuitry causes current flow through the first and second bipolar transistors to be equal so that the first bipolar transistor operates at a current density less than a current density of the second bipolar transistor.

3. The band gap circuit of claim 1 wherein a base of the third PNP transistor is connected to the bases of the first and second PNP transistors.

4. The band gap circuit of claim 3 wherein the voltage bias circuitry further includes an MOS transistor having a gate connected to an emitter of the third PNP transistor so that the base-collector bias voltage applied to the first and second PNP transistor is equal to a combination of a gate-source voltage of the MOS transistor and a base-emitter voltage of the third PNP transistor.

5. A band gap circuit comprising:

first and second PNP transistors having bases connected together and collectors connected together;

current biasing circuitry coupled to the first and second PNP transistors so that the second PNP transistor operates at a current density greater than the first PNP transistor, wherein the current biasing circuitry includes an error amplifier having first and second N type MOS transistors connected as a differential pair, with an output of the error amplifier controlling current flow through the first and second PNP transistors and wherein the error amplifier has a minimum common mode input voltage;

a first resistor connected in series with the emitter of the first PNP transistor so that a difference in a base-emitter voltage of the first and second PNP transistors is developed across the first resistor, output circuitry for combining a base-emitter voltage of a third PNP transistor with a voltage having a temperature coefficient related to the difference in a base-emitter voltage so as to produce a reference output voltage; and voltage bias circuitry coupled to the bases of the first and second PNP transistors to create a base-collector bias voltage on the first and second PNP transistors, with the base-collector bias voltage being approximately equal to the minimum common mode input voltage less the base-emitter voltage of the second PNP transistor.

6. The band gap circuit of claim 5 wherein second PNP transistor has an emitter area larger than an emitter area of the first PNP transistor and wherein current flow through the first and second PNP transistors is approximately equal.

7. The band gap circuit of claim 6 wherein the voltage bias circuitry further includes a second resistor coupled between the bases and the collectors of the first and second PNP transistors and wherein the current bias circuitry provides a bias current to the second resistor to produce the base-collector bias voltage.

8. The band gap circuit of claim 7 wherein the current bias circuitry causes current flow through the second resistor to be equal to the current flow through the first and second PNP transistors.

9. The band gap circuit of claim 5 wherein the voltage bias circuitry includes a third MOS transistor having a gate-source voltage that is used to produce the base-collector bias voltage.

10. The band gap circuit of claim 9 wherein the current biasing circuitry is further configured to provide a bias current to the third MOS transistor which is equal to the current flow through the first and second PNP transistors.

11. The band gap circuit of claim 10 wherein the voltage bias circuitry further including a fourth PNP transistor that produces a base-emitter voltage which is combined with the gate-source voltage of the third MOS transistor to produce the base-collector bias voltage.

12. The band gap circuit of claim 11 wherein the current bias circuitry biases the fourth PNP transistor such that current flow through the fourth PNP transistor is equal to current flow through the first and second PNP transistors.

13. The band gap circuit of claim 10 wherein the voltage bias circuitry further includes a second error amplifier having a first input coupled to a gate of the third MOS transistor, a second input coupled to an emitter of one of the first and second PNP transistors and an output connected to the bases of the first and second PNP transistors.

14. A method of producing a reference voltage comprising:

providing first and second vertical PNP transistors having common bases and common collectors, with the common collectors connected to a circuit common;

operating the first and second PNP transistors at different current densities;

applying a bias voltage across a base and collector of the first and second PNP transistors on the order of 500 millivolts;

producing a current related to a difference in base-emitter voltages of the first and second PNP transistors; and combining the current related to a difference in base-emitter voltages with voltage having a negative temperature coefficient so as to produce an output reference voltage.

15. The method of claim 14 further including producing the bias voltage by combining a gate-source voltage of an MOS transistor and a base-emitter voltage of a bipolar transistor.

16. A band gap circuit comprising:

first and second vertical PNP transistors having respective collectors connected in common and respective bases connected in common;

a resistor having first and second terminals, with the first terminal connected to an emitter of the first PNP transistor;

current biasing circuitry configured to cause the first and second PNP transistors to operate at different current densities, said current biasing circuitry including an error amplifier implemented using P and N type MOS transistors, including a pair of differentially-connected N type MOS transistors, and having a first input connected to an emitter of the second PNP transistor and a second input connected to the second terminal of the resistor and an output connected to maintain a same voltage at the first and second error amplifier inputs, with the error amplifier having a minimum common mode input voltage; and voltage bias circuitry configured to produce a base-collector bias voltage in the first and second PNP transistors, with the base-collector bias voltage being approximately equal to the minimum common mode input voltage less a base-emitter voltage of the second PNP transistor, with the voltage bias circuitry including an MOS transistor and a second error amplifier, with a first input of the second error amplifier connected to a gate of the MOS transistor of the voltage bias circuitry and second input is coupled to an emitter of one of the first and second PNP transistors and an output of the second error amplifier is connected to the bases of the first and second PNP transistors.

17. A method of producing a reference voltage comprising:

providing first and second PNP transistors having common bases and common collectors, with the common collectors connected to a circuit common;

operating the first and second PNP transistors at different current densities;

producing a current related to a difference in base-emitter voltages of the first and second PNP transistors;

combining the current related to a difference in base-emitter voltages with a voltage having a negative temperature coefficient so as to produce an output reference voltage;

providing an error amplifier connected to control current flow through the first and second PNP transistors; and applying a bias voltage across a base and collector of the first and second PNP transistors, with the bias voltage being approximately equal to a minimum common mode input voltage of the error amplifier less the base-emitter voltage of a PNP transistor.

18. The method of claim 17 wherein the applying includes the steps of producing a first voltage indicative of the minimum common mode input voltage and producing a second voltage related to a base-emitter voltage of a PNP transistor and subtracting the second voltage from the first voltage.

19. The method of claim 18 wherein the first voltage is produced from the gate-source voltage of an MOS transistor.

20. The method of claim 19 wherein the second voltage is produced from the base-emitter voltage of a third PNP transistor.

21. A band gap circuit comprising:

first and second PNP transistors having bases connected together and collectors connected together;

current biasing circuitry coupled to the first and second PNP transistors so that the second PNP transistor operates at a current density greater than the first transistor;

a first resistor connected in series with the emitter of the first PNP transistor so that a difference in a base-emitter voltage of the first and second PNP transistors is developed across the first resistor:

output circuitry for combining a base-emitter voltage of a third PNP transistor with a voltage having a temperature coefficient related to the difference in a base-emitter voltage so as to produce a reference output voltage; and voltage bias circuitry coupled to the bases of the first and second PNP transistors to create a base-collector bias voltage on the first and second PNP transistors, with the bias voltage having a magnitude on the order of 500 millivolts.

22. A band gap circuit comprising:

first and second PNP transistors having bases connected together and collectors connected together;

current biasing circuitry coupled to the first and second PNP transistors so that the second PNP transistor operates at a current density greater than the first PNP transistor;

a first resistor connected in series with the emitter of the first PNP transistor so that a difference in a base-emitter voltage of the first and second PNP transistors is developed across the first resistor:

output circuitry for combining a base-emitter voltage of a third PNP transistor with a voltage having a temperature coefficient related to the difference in a base-emitter voltage so as to produce a reference output voltage; and voltage bias circuitry coupled to the bases of the first and second PNP transistors to create a base-collector bias voltage on the first and second PNP transistors, with the bias voltage having a magnitude determined by the combination of a gate-source voltage of an MOS transistor and a base-emitter voltage of a bipolar transistor.

23. The band gap circuit of claim 22 wherein the voltage bias circuitry includes a fourth PNP transistor and an MOS transistor and wherein the bias voltage has a magnitude equal to a difference in magnitude of a gate-source voltage of the MOS transistor and a base-emitter voltage of the fourth PNP transistor.

24. The band gap circuit of claim 22 wherein the voltage bias circuitry includes an MOS transistor and an error amplifier having first and second amplifier inputs and an amplifier output, with the first amplifier output coupled to the bases of the first and second PNP transistors, the first input coupled to an emitter of a selected one of the first and second PNP transistors and the second input coupled to a gate of the MOS transistor.

* * * * *